US007234427B2

(12) United States Patent
Lehmann et al.

(10) Patent No.: US 7,234,427 B2
(45) Date of Patent: Jun. 26, 2007

(54) LOCKING DEVICE FOR A CAMSHAFT ADJUSTER

(75) Inventors: Kai Lehmann, Ludwigsfelde (DE); Jens Plank, Berlin (DE); Holger Rudsinzki, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 148 days.

(21) Appl. No.: 11/104,167

(22) Filed: Apr. 7, 2005

(65) Prior Publication Data

US 2005/0205032 A1 Sep. 22, 2005

Related U.S. Application Data

(63) Continuation-in-part of application No. PCT/EP03/10339, filed on Sep. 17, 2003.

(30) Foreign Application Priority Data

Oct. 8, 2002 (DE) ..... 102 46 838

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,035,816 A * 3/2000 Ogawa et al. ..... 123/90.17
2002/0078913 A1 6/2002 Fukuhara et al.

FOREIGN PATENT DOCUMENTS

| | | |
|---|---|---|
| DE | 198 25 287 | 12/1998 |
| DE | 199 18 910 | 11/1999 |
| DE | 100 38 082 | 3/2001 |
| DE | 100 64 222 | 8/2001 |
| DE | 101 27 168 | 2/2002 |
| DE | 100 55 334 | 5/2002 |
| EP | 0 818 610 | 7/1997 |
| JP | 11 241607 | 9/1999 |
| WO | WO 0242613 A1 * | 5/2002 |

* cited by examiner

*Primary Examiner*—Ching Chang
(74) *Attorney, Agent, or Firm*—Klaus J. Bach

(57) ABSTRACT

In a locking device for a camshaft adjuster comprising a drive housing with a rotor with spaced rotor vanes disposed in the drive housing between circumferentially spaced axial walls projecting radially inwardly so as to form operating chambers at opposite sides of the rotor vanes to which hydraulic fluid can be selectively admitted for controlling the relative angular position between the rotor to which a camshaft is connected and the drive housing which is driven by the crankshaft of the engine, wherein locking bolts are provided for interlocking the drive housing and the vane rotor and disposed in one of the housing and the rotor elements while a recess is formed in the other for receiving the locking bolt in order to interlock the drive housing and the vane rotor, the locking bolt is arranged in the hydraulic fluid supply path to the operating chambers upstream of the operating chamber in such a way that hydraulic fluid admission to the operating chambers is controlled by the locking bolt and is admitted to the operating chambers by the movement of the locking bolt to the release position.

9 Claims, 5 Drawing Sheets

LOCKING DEVICE FOR A CAMSHAFT ADJUSTER

This is a Continuation-In-Part Application of International Application PCT/EP2003/010339 filed 17 Sep. 2003 and claiming the priority of German application 102 46 838.9 filed 8 Oct. 2002.

BACKGROUND OF THE INVENTION

The invention relates to a locking device for a camshaft adjuster including a vane rotor mounted on the camshaft and disposed in a drive housing such that the angular position of the vane rotor relative to the drive housing is adjustable.

Camshaft adjusters are used in valve-controlled internal combustion engines in order to vary the rotational angle or to bring about a phase offset of the camshaft relative to the crankshaft or other camshafts. The opening times of the exhaust and inlet valves are thereby advanced or retarded in relation to the top dead center position of a piston, in order to optimize the charge cycle of the combustion chambers or cylinders as a function of the operating point of the internal combustion engine at any given time.

DE 101 27 168 A1 discloses a camshaft adjuster having a vane rotor. The vane rotor is rotationally locked to the camshaft and is supported so that it can rotate to a limited extent in a drive part, which is generally driven by the crankshaft of the internal combustion engine by way of a toothed belt. With its vanes the vane rotor meshes in gaps in the drive part which are formed by projections extending radially inwards. The projections define the maximum rotational angle though which the vane rotor can be turned relative to the drive part. Between the vanes and the projections hydraulic chambers are formed, which are controlled by a control valve, so that the position of the vane rotor relative to the drive part is determined by the pressure ratios of the pressure chambers situated in a peripheral direction on both sides of a vane.

When the internal combustion engine is shut down springs set the vane rotor to one of the two limit positions. Upon starting of the internal combustion engine the rotating cams of the camshaft exert alternating reaction forces in the direction of rotation, which lead to advancing or retarding torques. If only a slight pressure, if any, has built up in the pressure chambers, the reaction forces overcome the spring forces, so that the vanes in contact with the radial projections lift off and move to the opposite radial projection. When they strike against these, or when they impinge on the contact face again when the reaction forces are reversed, they generate annoying noises. For this reason the vane rotor is generally locked in relation to the drive part by a locking bolt, which is supported either in the vane rotor or in the drive part so that it is axially or radially displaceable, and extends in a locking well in the other part. A spring presses the locking bolt into the locking well. The locking bolt is hydraulically released by the control valve first admitting fluid to a pressure chamber when the internal combustion engine is started. When the pressure in the pressure chamber becomes greater than the pressure of the locking spring, the locking bolt is pushed out of the locking well and the camshaft adjuster is operable.

In the locked limit position of the vane rotor, the camshaft must be held at an angle of rotation, relative to the position of the camshaft, which is conducive to the startup of the internal combustion engine. For this reason an inlet valve camshaft adjuster is generally locked in a retarded limit position and an exhaust valve camshaft adjuster in an advanced limit position. In order to allow a larger adjustment range, particularly for the inlet valves, the vane rotor is locked between the two limit positions for starting of the internal combustion engine. After starting, with the locking bolt in the release position a control valve controls or regulates the rotational angle according to recorded operating performance characteristics of the internal combustion engine.

Locking the camshaft adjuster in a middle position is difficult, because the relative speed between the vane rotor and the drive part is very high when the camshaft adjuster is not activated and the pressure chambers are unpressurized. In this operating state the drive forces, which the crankshaft exerts on the drive part, cause the camshaft adjuster to shift to a retarding position. For improved engagement of the locking bolt the known locking device has a stepped locking well, the outer step of which takes the form of an elongated hole in the adjusting direction. In the event of a shift towards a retarding position when the pressure chambers are unpressurized, the locking bolt initially engages in the first step, which prevents the movement in the opposite direction beyond the middle position, in that one end of the elongated hole coincides with the middle position. At this end two steps are congruent, so that the locking bolt can engage in the second step, thereby locking the vane rotor in both adjusting directions. In one embodiment multiple steps may also be provided, which progressively restrict the freedom of movement of the locking bolt, the innermost step taking the form of a fixing well. The steps may furthermore extend in a peripheral direction to both sides of the innermost step.

The steps result in a relatively long radial adjustment travel for the locking bolt and hence a long spring travel of the locking spring. Furthermore, its free end is highly stressed when it is inserted and strikes against the limit of a step, so that it is subject to a large amount of wear. Over time this can result in a large amount of play between the innermost step, which serves as fixing well, and the locking bolt. The steps and the locking bolt are therefore hardened at the critical points.

DE 199 18 910 A1 discloses a camshaft adjuster which has two spring-loaded locking bolts which are spaced over the circumference of the vane rotor and which are displaceably guided either radially or axially in the drive part, and which, in the locking position, project into a locking well of the vane rotor. The locking bolts are hydraulically released in that a pressure acting in the pressure chambers acts on an end face of the locking bolts and shifts them into a release position against the force of the loading spring as soon as the pressure has attained a corresponding value. In this case the release bolts are cylindrical and are each subjected only to the pressure prevailing in either one of the pressure chambers acting in the retarding or advancing direction.

As a variant, the locking bolts take the form of stepped pistons, the small piston face being acted upon by the pressure of one pressure chamber and larger piston face by the pressure of the other pressure chamber. The resulting force generated by the pressures shifts the locking bolts into the release position.

Whilst one of the locking bolts interacts with a cylindrical recess designed as fixing well, which serves to lock the vane rotor in both directions of rotation, the other locking bolt interacts with an elongated hole, which extends over a circular path and one end of which defines the same locking position of the vane rotor, whilst the other end extends in the retarding direction.

If the one locking bolt is situated in the area of the elongated hole when the internal combustion engine is switched off, it can engage therein as soon as the pressure in the pressure chambers falls below a certain value. Once the locking bolt reaches the end of the elongated hole in the middle position of the vane rotor, the second locking bolt engages in the fixing well, so that the vane rotor is locked to the drive part in both directions of rotation. If the one locking bolt is situated outside the area of the elongated hole, for example in the area in which the greatest adjustment in the retarding direction is reached, oscillations when the internal combustion engine is started up will cause the vane rotor to move in the advancing direction, one locking bolt engaging in the elongated hole and preventing any return in the retarding direction, so that the other locking bolt can engage in the fixing well.

It is the object of the present invention to improve, by simple means, the release and locking of a camshaft adjuster also between the limit positions of its adjustment range.

SUMMARY OF THE INVENTION

In a locking device for a camshaft adjuster comprising a drive housing with a rotor with spaced rotor vanes disposed in the drive housing between circumferentially spaced axial walls projecting radially inwardly so as to form operating chambers at opposite sides of the rotor vanes to which hydraulic fluid can be selectively admitted for controlling the relative angular position between the rotor to which a camshaft is connected and the drive housing which is driven by the crankshaft of the engine, wherein locking bolts are provided for interlocking the drive housing and the vane rotor and disposed in one of the housing and the rotor elements while a recess is formed in the other for receiving the locking bolt in order to interlock the drive housing and the vane rotor, the locking bolt is arranged in the hydraulic fluid supply path to the operating chambers upstream of the operating chamber in such a way that hydraulic fluid admission to the operating chambers is controlled by the locking bolt and is admitted to the operating chambers by the movement of the locking bolt to the release position.

The locking bolt may be arranged either upstream of the control valve or between the control valve and the pressure chambers. The locking bolt may have various embodiments, for example it may take the form of a stepped piston and a piston step may control a fluid supply duct to the operating chambers or to the control valve. The locking bolt may furthermore have a second piston step, which controls a second fluid supply duct to an operating chamber for the opposite adjusting direction, so that the locking bolt controls the fluid flow to both types of operating chambers, and release occurs no matter to which of the operating chambers fluid is admitted.

Instead of a stepped piston the locking bolt may also take the form of a cylindrical control piston, which together with the associated locking well forms a pressure chamber, which is connected by way of a central bore to a radial control bore, which controls the connecting duct to the operating chambers or the control valve. The embodiment of the locking bolt as a cylindrical control piston may be combined with the embodiment as stepped piston, so that one connecting duct is controlled by the stepped piston and the other connecting duct by the radial control bore.

When the internal combustion engine is started up and the camshaft adjuster is activated, an actuating pressure, which releases the locking bolt as soon as it overcomes the spring force of the compression spring loading the locking bolt in the locking direction, is built up upstream of the locking bolt. In the release position of the locking bolt the fluid is admitted to the operating chambers, which fill within a very brief time, for example within a few milliseconds. The camshaft adjuster thereby on the one hand responds to an activation very rapidly, since it is already released before the operating chambers are filled. On the other hand, the pressure chambers are filled so rapidly that the noises described above are reliably prevented.

The locking bolt is furthermore held in the release position both by the actuating pressure and by the pressure in the operating chambers, so that it does not engage during engine operation, even if the locking position is in an intermediate position between the limit positions and has to be passed over in the course of adjustment. When the internal combustion engine is switched off, the actuating pressure and the pressure in the pressure chambers fall and the locking bolt is displaced in the locking direction by the compression spring, so that it engages in the locking well.

Since the speed of the vane rotor relative to the drive part can be very high owing to the reaction forces acting on them, a reliable engagement of the locking bolt is not always assured, particularly when the locking position lies between the two limit positions. It is therefore advisable for the locking device to have at least two locking bolts spaced over the circumference, at least one of which interacts with a detent recess which is elongated in a circumferential direction. With the associated locking bolt engaged, one end of the detent recess limits the adjusting movement of the vane rotor in the position in which the other locking bolt engages. Owing to the extent of the detent recess in the circumferential direction, the assigned locking bolt has a larger time window available for engagement. In one embodiment the one locking bolt acts as detent bolt, which restricts the freedom of movement in the area of the locked position, whilst the other locking bolt functions as fixing bolt and prevents any rotation of the vane rotor relative to the drive part in both directions.

According to a further embodiment of the invention a detent recess is assigned to each locking bolt, the locking bolts in the locked position bearing on the ends of the detent recesses, which are opposed to the adjusting direction. The vane rotor is therefore locked to the drive part between the two bearing faces of the locking bolts. The detent device furthermore acts regardless of the direction of the relative movement between the vane rotor and the drive part.

In order to control the fluid inflow to the operating chambers, which are assigned to different adjusting directions, the adjusting bolt may be designed in accordance with this dual function. If at least two locking bolts are provided, spaced over the circumference, it may be advisable for the functions to be divided between the locking bolts, and for one locking bolt to be assigned to the pressure chambers for one adjusting direction and the other locking bolt to the other pressure chambers.

The invention will become more readily apparent from the following description. Embodiments thereof shown by way of example only in the accompanying drawings.

DESCRIPTION OF PREFERRED EMBODIMENTS

Figure 1:
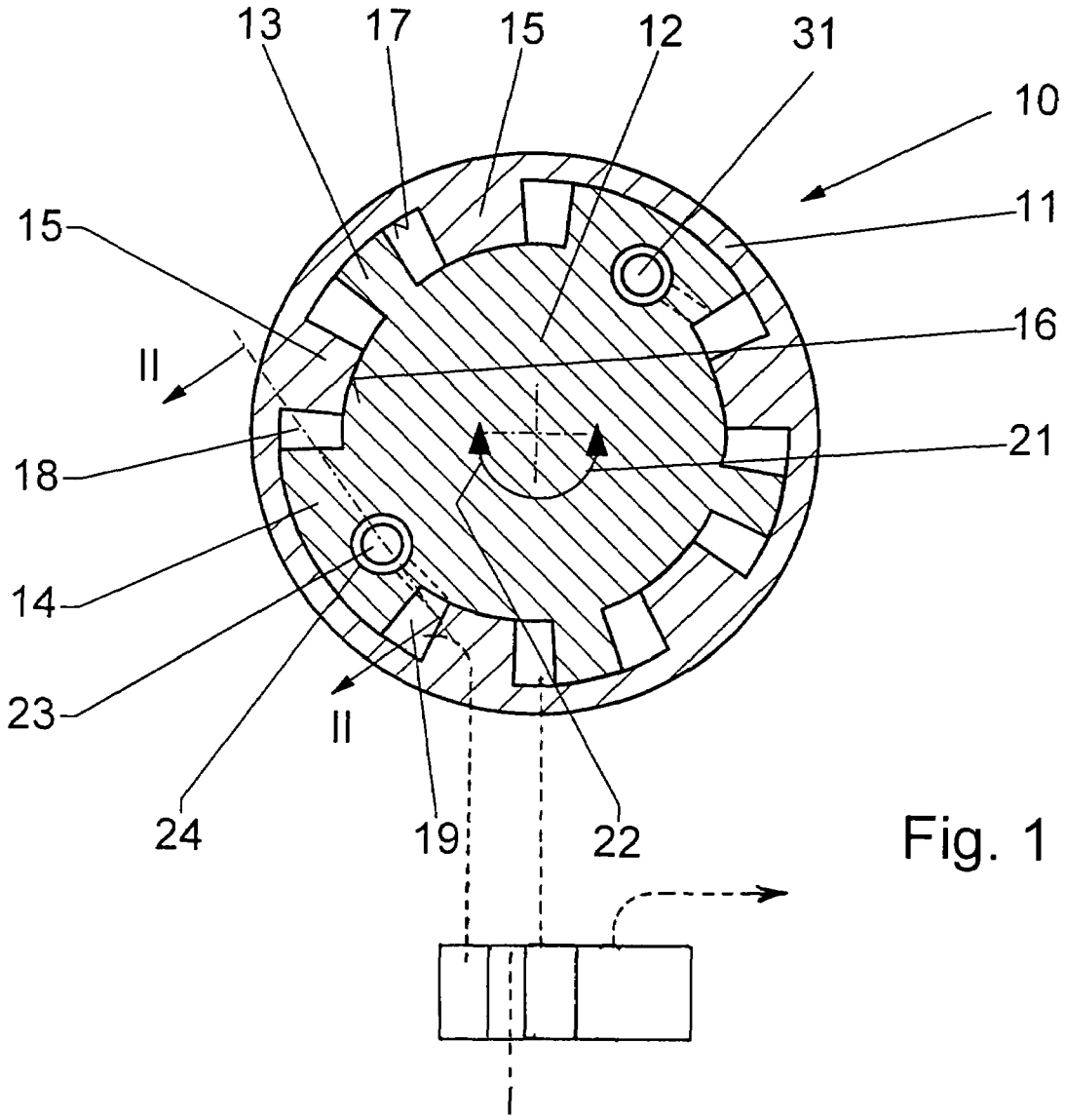
FIG. 1 is a schematic cross sectional view of a camshaft adjuster.

A camshaft adjuster 10 has a drive part 11 and a vane rotor 12 including vanes 13, 14 which extend in gaps in the drive part 11. The gaps are formed by radial projections 15, which extend between an inner base circle 16 and an outer circumference 17. On both sides of the vanes 13 and 14 operating chambers 18 and 19, to which hydraulic oil can be admitted by a control valve (not shown), are formed between the vanes 13 and 14 and the radial projections 15. According to the pressure differential in the operating chambers 18, 19, the vane rotor 12 is shifted in one adjusting direction 21 or in the other adjusting direction 22 relative to the drive part 11.

The vane rotor 12 is rotationally locked to a camshaft (not shown), whilst the drive part is driven by a crankshaft (likewise not shown) of an internal combustion engine. An adjustment of the vane rotor 12 in the adjusting direction 21 means that opening of the exhaust and inlet valves of the internal combustion engine is retarded, whereas in the case of an adjustment in the adjusting direction 22 opening of the exhaust and inlet valves is advanced.

The drive part 11 has end covers 20, which define the ends of the pressure chambers 18, 19. In operating intervals, especially just before starting or in the starting phase, the vane rotor 12 is locked in relation to the drive part 11. Two locking bolts 23 and 31, which interact with engagement recesses in the form of a locking well 24 and detent recesses 37 to 41, serve for this purpose. The locking bolts 23, 31, 32, 33 may be arranged axially or radially in the vane rotor 12 or the drive part 11, the engagement recesses in either case being situated in the other component 11 or 12. The vane rotor 12 can be locked to the drive part 11 in a limit position, in which the vanes 13, 14 bear on a radial projection 15 or, as shown, in an intermediate position between the two possible limit positions.

The locking bolts 23, 31, 32, 33 are arranged hydraulically upstream of the pressure chambers 18, 19 and admit the operating fluid in their release position. FIG. 2 to FIG. 5 show various embodiments of locking bolts 23, 31, 32, 33. The locking bolt 23 according to FIG. 2 takes the form of a stepped piston having a piston step 26. Hydraulic fluid admitted through actuating connection 25 moves the bolt 23 out of its locking position against the spring force 30 of a compression spring. When the actuating pressure in the actuating connection 25 increases, the locking bolt 23 is displaced against the spring force 30 and moves out of the locking well 24. At the same time a connecting duct 29 is opened, which leads to the operating chambers 18 or 19 or to a control valve (not shown), which controls the pressure in the operating chambers 18, 19.

Figure 2:
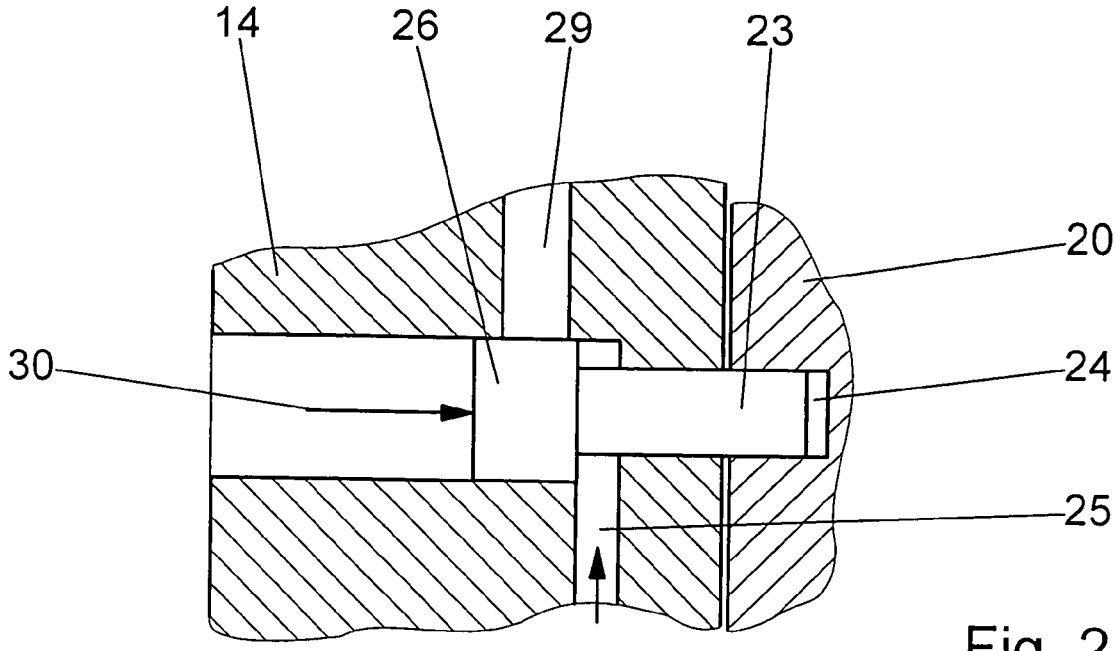
FIG. 2 shows a section taken along the line II-II of FIG. 1.
Figure 3:
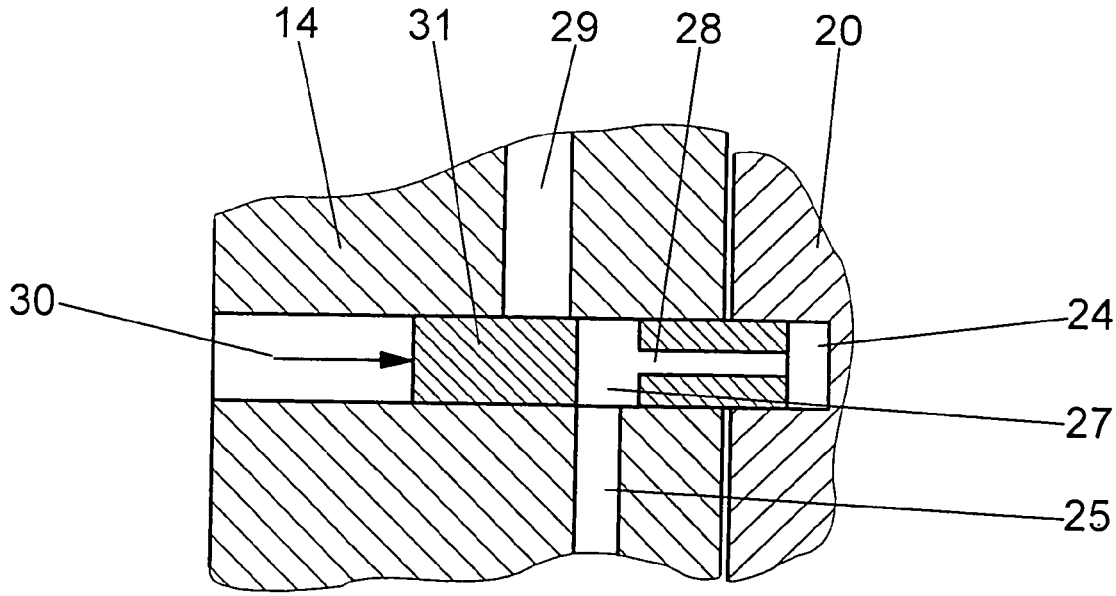
FIG. 3-FIG. 5 show variants of the arrangement shown in FIG. 2.

The embodiment according to FIG. 3 differs from the embodiment according to FIG. 2 in that the locking bolt 31 has a cylindrical peripheral contour and at the end together with the locking well 24 forms a pressure chamber, which is connected by way of a central bore 28 and a radial control bore 27 to the actuating connection 25. When the pressure in the actuating connection 25 rises, the locking bolt 31 is released against the spring force 30 and in the process simultaneously opens up the flow passage between the actuating connection 25 and the connecting duct 29.

Figure 4:
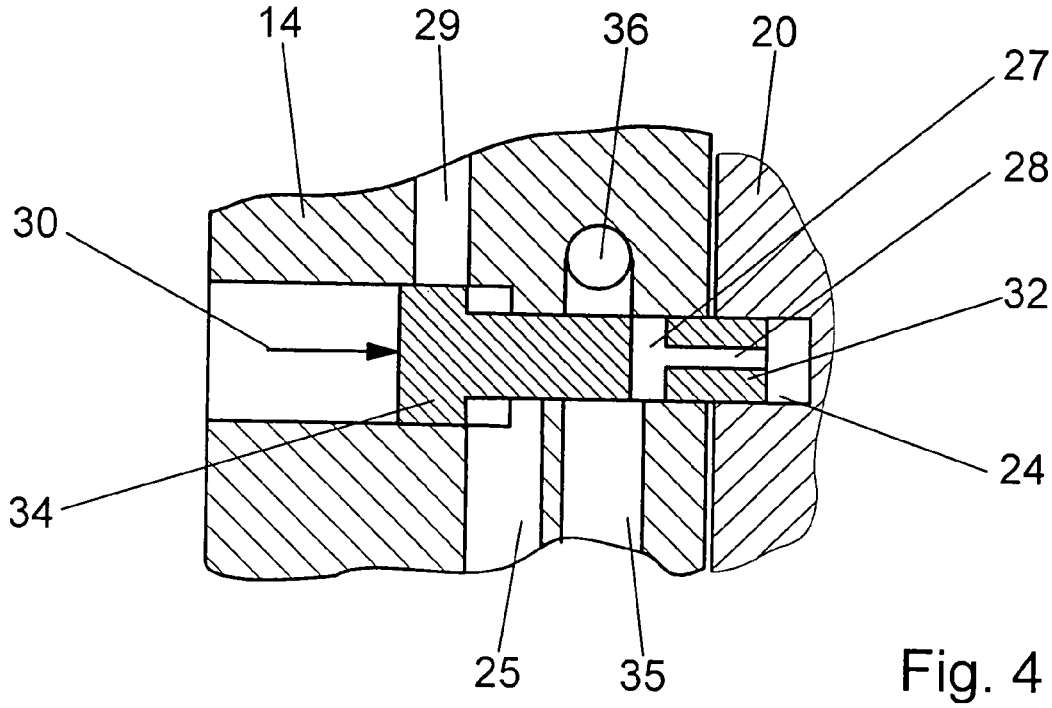
Figure 5:
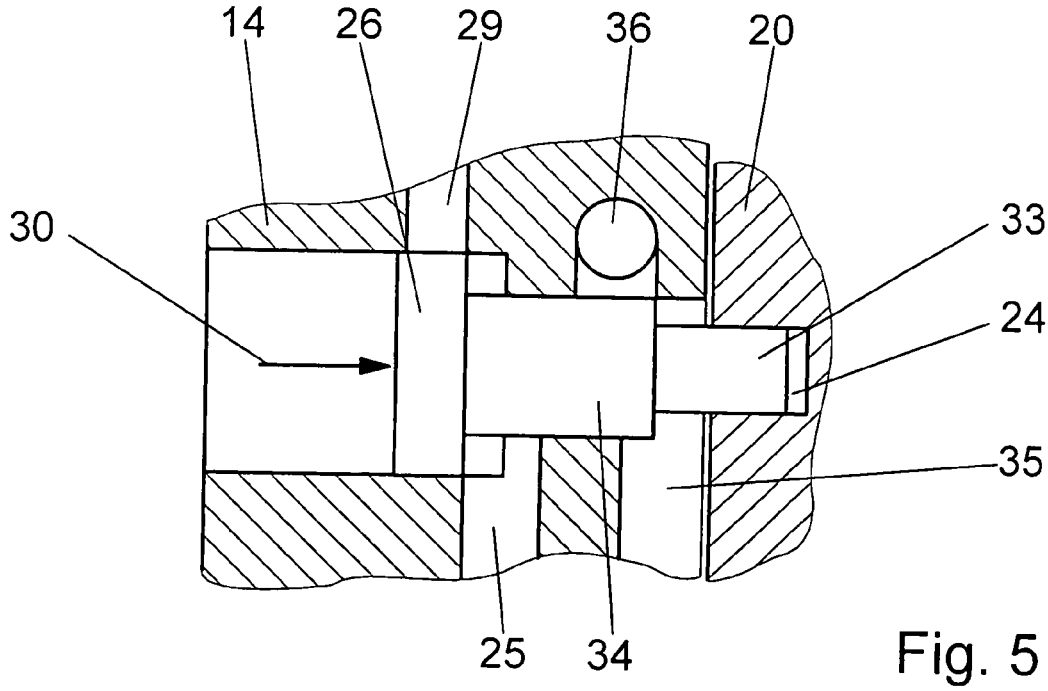
Figure 6:
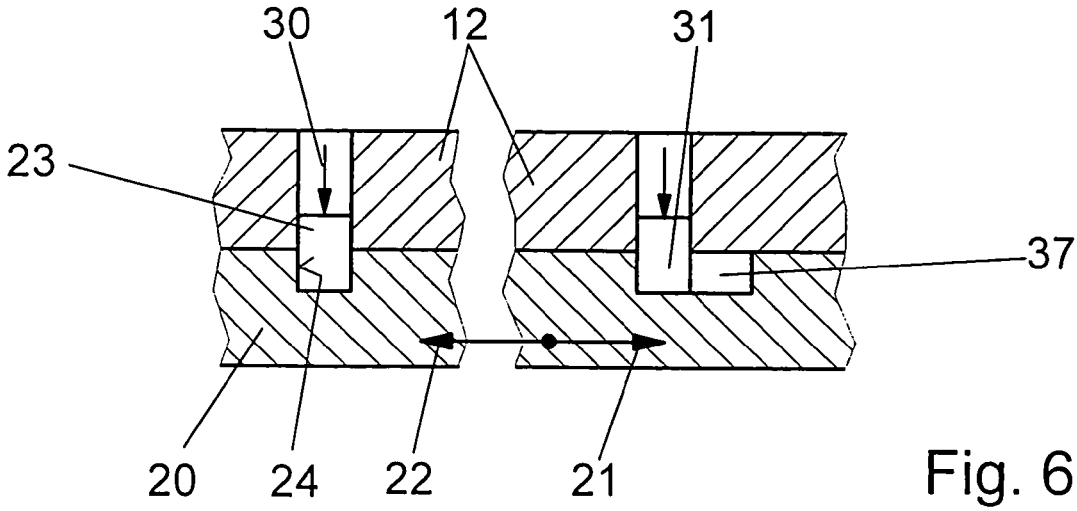
FIG. 6 shows, in a schematic sectional view, an area of two locking bolts assigned to one another.

The embodiments according to FIG. 4 and FIG. 5 have two connecting ducts 29, 36, one 29 of which is assigned for example to the one operating chamber 18 and the other connecting duct 36, for example, to the other operating chamber 19. In the embodiment according to FIG. 4 the locking bolt 32 has a piston step 34, which controls the flow between the actuating connection 25 and the connecting duct 29, whilst the locking end of the locking bolt 32 as shown in the example according to FIG. 3 has a central bore 28 and a radial control bore 27. This controls the flow between an actuating connection 35 and the connecting duct 36.

In the embodiment according to FIG. 5 the locking bolt 33 has two stepped pistons 26 and 34, the piston step 26 of which, as in the embodiments according to FIG. 2 and FIG. 4, controls the flow between the actuating connection 25 and the connecting duct 29. The second piston step 34 controls the flow between the actuating connection 35 and the connecting duct 36.

In the variants depicted only one locking bolt is generally required for locking the vane rotor 12 in relation to the drive part 11. If the fluid flow is to be routed between two actuating connections 25, 35 to two connecting ducts 29, 36, the embodiments according to FIGS. 4 and 5 may be considered for one locking bolt. If multiple locking bolts 23, 31 are provided, spaced over the circumference, it is possible for one of them to be designed as shown in the embodiment according to FIG. 4 or 5, or for both of them to be designed as shown in the embodiment according to FIG. 2 or 3 and to control the flow to the pressure chambers 18 or 19 respectively.

Figure 7:
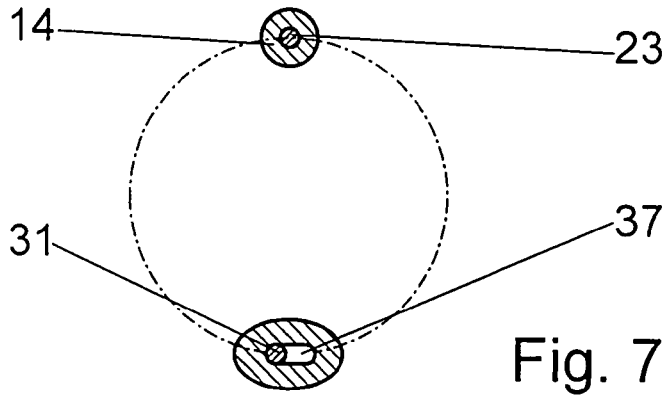
FIG. 7 shows the position of the locking bolts in the adjusting direction of the camshaft adjuster and FIG. 8 to FIG. 9 show variants of FIG. 6.

FIG. 6 to FIG. 9 show locking bolts 23, 31 in connection with engagement recesses in the form of a locking well 24 and/or detent recesses 37, 38, 39, 40 and 41. FIG. 7 shows a possible arrangement of the locking bolts 23 and 31 spaced over the circumference. In this case the locking bolt 23 interacts with the locking well 24 and acts as a centering bolt, which in the locking position locks the vane rotor 12 in both adjustment directions 21, 22 over the cover 20 of the drive part 11. The second locking bolt 31 interacts with a detent recess 37. If the vane rotor 12 moves in the adjusting direction 22 relative to the cover 20, the locking bolt 31 under the spring force 30 engages in the elongated detent recess 37 and hold the vane rotor at the end of the detent recess 37. In this position the centering bolt 23 can move into the locking well 24, with the result that the vane rotor 12 is locked in both adjusting directions 21, 22.

Figure 8:
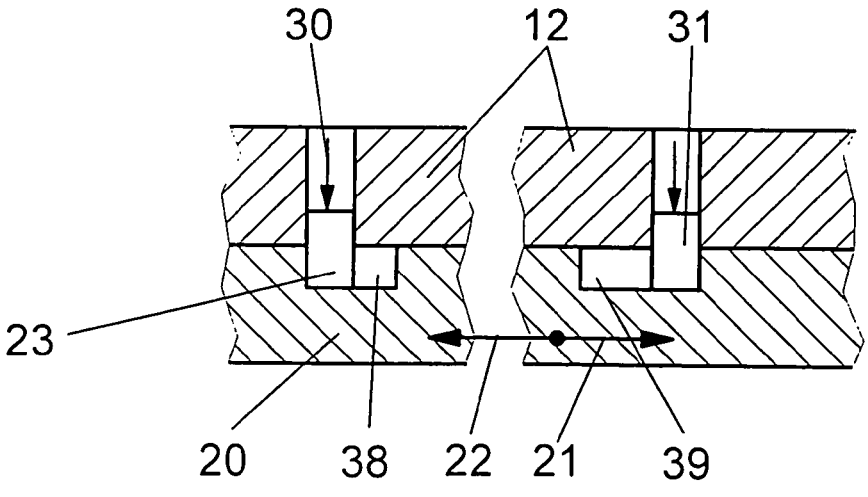
Figure 9:
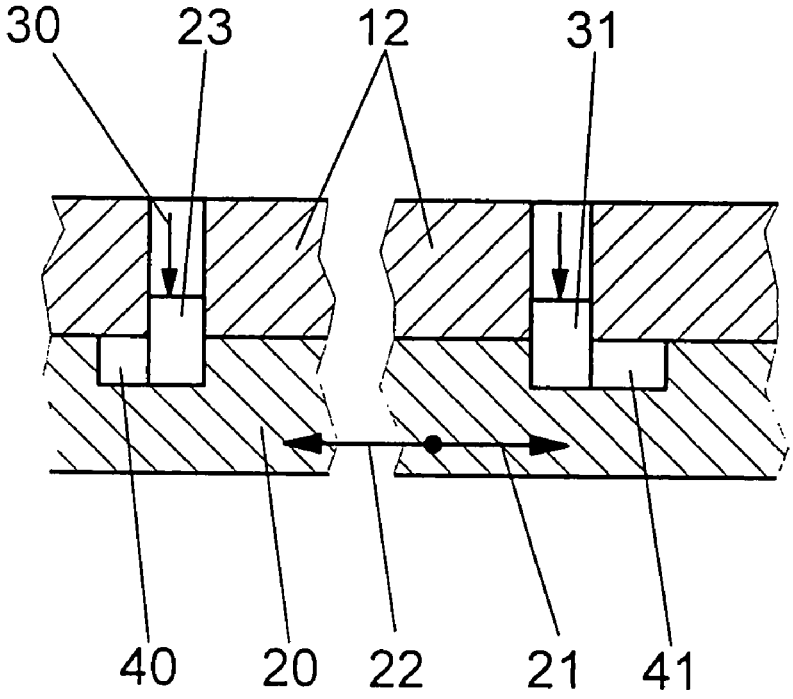

In the embodiments according to FIG. 8 and FIG. 9 an elongated detent recess 38, 39 is assigned to both locking bolts 23, 31. In the embodiment according to FIG. 8 the detent recess 38 in the locking position shown limits the relative movement of the vane rotor 12 in the adjusting direction 22, whereas the detent recess 39 limits the relative movement in the opposite adjusting direction 21. In the embodiment according to FIG. 9 the detent recesses 40 and 41 are arranged so that, in the locked position shown, the locking bolt 23 prevents the relative movement of the vane rotor 12 in the adjusting direction 21, whereas the detent recess 41 limits the relative movement in the opposite adjusting direction 22. The locking bolts 23, 31 may be replaced, as desired, by the locking bolts 32, 33 according to FIG. 4 and FIG. 5.

What is claimed:

1. A locking device for a camshaft adjuster, comprising an annular drive part (11) having spaced projections (15, 16) extending radially inwardly, a vane rotor (12) rotationally locked to a camshaft and being rotatably supported in the annular drive part (11), the vane rotor (12) having circumferentially spaced rotor vanes (13, 14) extending radially out-wardly between the spaced projections (15, 16) of the annular drive part (11) so as to form operating chambers (18, 19) at the opposite side of each rotor vane (13, 14), means for supplying hydraulic fluid to the operating chambers (18,19) for controlling the angular position of the vane rotor (12) relative to the drive part (11) depending on the pressure ratio in the operating chambers (18, 19), and the locking device including at least two hydraulically releasable locking bolts (23, 31) axially movably supported in a bore of one of the annular drive part (11) and the vane rotor (12) and biased toward the other of the annular drive part (11) and the vane rotor (12), the other including dent recesses for receiving the locking bolts for interlocking the drive part (11) and the vane rotor (12), the locking bolt (23, 31) being arranged hydraulically upstream of the operating chambers (18, 19) so as to permit the inflow of hydraulic fluid into the pressure chambers when the locking bolt (23, 31, 32, 33) is in a release position, but blocking the hydraulic fluid flow in its locking position at least one of the detent recesses (37 to 41) being elongated in a circumferential direction, such that the at least one recess, with the associated locking bolt (31) engaged therein, limits relative movement between the vane rotor (12) and the drive part (11) thereby facilitating subsequent engagement of the other locking bolt (23) in the other engagement recess (24, 31, 32, 33).

2. The locking device as claimed in claim 1, wherein the locking bolt (23, 31, 32, 32) is a piston structure movably disposed in the bore so as to control fluid flow passages arranged upstream of a control valve.

3. The locking device as claimed in claim 2, wherein the locking bolt (23, 32, 33) is a stepped piston having one piston step (26) controlling a connecting duct (29) for supplying hydraulic fluid to the operating chambers (18, 19) for operation in one adjustment direction.

4. The locking device as claimed in claim 3, wherein the looking bolt (33) has a second piston step (34), which controls a second connecting duct (36) to an operating chamber (18, 19) for the opposite adjusting direction.

5. The locking device as claimed in claim 4, wherein the locking bolt (32), at the end facing an engagement recess (24), is a cylindrical control piston, which with the engagement recess (24, 31, 32, 33) forms a pressure chamber, which is connected by way of a central bore (28) to a radial control bore (27), which controls the second connecting duct (36) to the operating chambers (18, 19).

6. The locking device as claimed in claim 1, wherein the locking bolt (23, 31, 32, 33) is arranged between a control valve and the pressure chambers (18, 19).

7. The locking device as claimed in claim 1, wherein the locking bolt (31) is a cylindrical control piston, which, with the associated engagement recess (24, 31, 32, 33), forms a pressure chamber, which is connected by way of a central bore (28) to a radial control bore (27), which controls fluid flow to the connecting duct (29, 36) to the operating chambers (18, 19).

8. The locking device as claimed in claim 1 wherein an elongated detent recess (38, 39, and 40, 41) is assigned to each locking bolt (23, 31) and the locking bolts (23, 31) in the locked position bear on the ends of the detent recesses (38 and 39; 40 and 41).

9. The locking device as claimed in claim 1, wherein the locking bolts (23, 31) are each assigned to pressure chambers (18, 19), which are each assigned to an adjusting direction (21, 22).

* * * * *